US006545646B2

(12) United States Patent
Marchand

(10) Patent No.: US 6,545,646 B2
(45) Date of Patent: Apr. 8, 2003

(54) INTEGRATED DIPOLE DETECTOR FOR MICROWAVE IMAGING

(75) Inventor: J. F. Phillippe Marchand, Rochester, NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/682,061

(22) Filed: Jul. 16, 2001

(65) Prior Publication Data

US 2003/0011528 A1 Jan. 16, 2003

(51) Int. Cl.[7] ..... H01Q 9/16
(52) U.S. Cl. ..... 343/793; 343/745; 343/893
(58) Field of Search ..... 343/700 MS, 793, 343/878, 893, 801, 745

(56) References Cited

U.S. PATENT DOCUMENTS

| | | | | | |
|---|---|---|---|---|---|
| 3,560,978 | A | * | 2/1971 | Himmel et al. | 342/399 |
| 3,919,638 | A | * | 11/1975 | Belden, Jr. | 324/72.5 |
| 4,338,595 | A | * | 7/1982 | Newman | 250/250 |
| 4,789,869 | A | * | 12/1988 | Aslan | 343/792 |
| 5,030,962 | A | * | 7/1991 | Rees | 343/700 MS |
| 6,407,719 | B1 | * | 6/2002 | Ohira et al. | 343/750 |

* cited by examiner

*Primary Examiner*—Don Wong
*Assistant Examiner*—Shih-Chao Chen
(74) *Attorney, Agent, or Firm*—Oliff & Berridge, PLC

(57) ABSTRACT

An integrated diode detector for an imaging system is facilitated by fabricating a Schottky diode between the quarter wavelength arms of a photolithographically manufactured one-half wavelength resonator.

25 Claims, 7 Drawing Sheets

INTEGRATED DIPOLE DETECTOR FOR MICROWAVE IMAGING

BACKGROUND OF THE INVENTION

1. Field of Invention

This invention is directed to an integrated dipole detector for microwave imaging systems.

2. Description of Related Art

In conventional microwave imaging systems, various halfwave antennas have been used to receive energy from a transmitted antenna to image an object in the field of the receiving antennas. It is well known that a very simple and effective halfwave receiving antenna can be formed by connecting quarter wavelength conducting arms to the end of the inner and outer conductors of an exposed coaxial cable to form a halfwave dipole antenna. Time-harmonic electromagnetic voltages that are induced on the halfwave dipole antenna are detected by a microwave-frequency sensitive rectifier, such as, for example, a diode located at a base of the coaxial cable.

It is well appreciated that the fabrication of conventional coaxial-dipole receiving antennas are not readily amenable to methods suited for mass production. That is, conventional coaxial-dipole receiving antennas are typically manufactured "by hand". Therefore, conventional coaxial-dipole receiving antennas are often very dependent on the relative skill of the craftsman. Thus, conventional coaxial-dipole receiving antennas suffer from lack of uniformity and quality, and are often unwieldy in size and expensive.

SUMMARY OF THE INVENTION

There is a need in the microwave imaging community for a compact and easily replicatable dipole receiving antenna.

This invention provides various exemplary embodiments of a compact dipole receiving antenna with an integrated detector. In particular, photolithographic and/or printed circuit board printing techniques can be used to fabricate a microwave-frequency dipole antenna with an integrated Schottky diode located between the opposing arms of a halfwave dipole radiator.

In various exemplary embodiments, the rectified field voltages may be filtered or further detected by placing capacitors and/or resistors in series or in parallel to the integrated Schottky diode. Because photolithographic and/or printed circuit board printing techniques can be used to fabricate the dipole antenna, the quality and compactness of the dipole detector can be greatly increased.

These and other features and advantages of this invention are described in or are apparent from the following detailed description of the exemplary embodiments.

BRIEF DESCRIPTION OF DRAWINGS

The exemplary embodiments of this invention will be described in detail, with reference to the following figures, wherein.

DETAILED DESCRIPTION OF PREFERRED EMBODIMENTS

Figure 1:
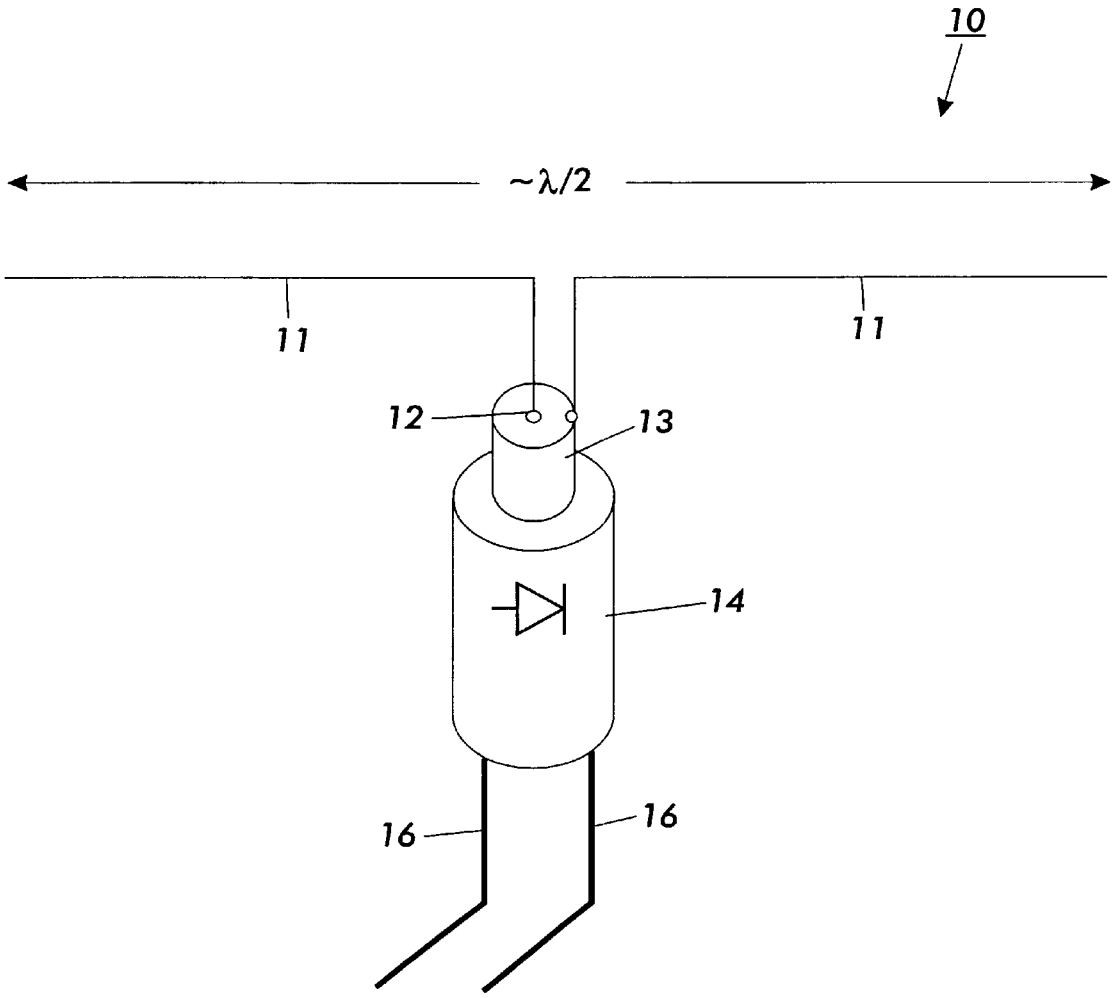
(PRIOR ART) FIG. 1
FIG. 1 illustrates a conventional dipole-coaxial antenna detector.

FIG. 1 shows a conventional dipole-coaxial detector 10 using a half-wavelength dipole antenna 11 attached to a coaxial cable having a center conductor 12 and an outer conductor 13. The wavelength of the dipole antenna 11 is tuned to microwave frequencies, as is well understood in the art. The dipole-coaxial antenna configuration is attached to a base 14 containing a microwave frequency detector (not shown), such as, for example, a diode, that converts the received microwave signals to a detectable voltage. The detective voltage is then transferred to other devices, (not shown) via electrical wires 16, for processing, etc.

Figure 2:
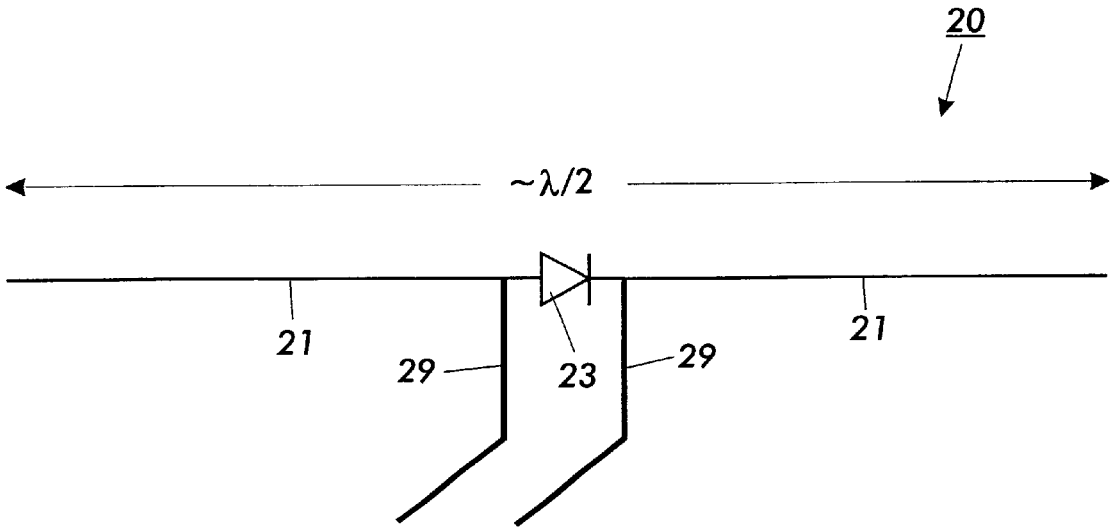
FIG. 2 illustrates a first exemplary embodiment of an integrated microwave imaging detector according to this invention.

FIG. 2 illustrates a first exemplary embodiment of an integrated microwave imaging detector 20 according to this invention. Quarter wavelength arms 21 are colinearly located and bridged by a rectifier 23, such as, for example, a diode. The diode can be a Schottky diode, a zero-bias Schottky diode or the like. Field voltages detected by the rectifier 23 are conducted to other devices (not shown) by electrical lines 29.

The quarter wavelength arms 21 and the rectifier 23 can be fabricated using photolithographic, printed circuit board, or other masking techniques that are well known in the art. Because these and other similar techniques can be applied to manufacture the integrated microwave imaging detector 20, the integrated microwave imaging detector 20 can be reliably produced in mass quantity.

Figure 3:
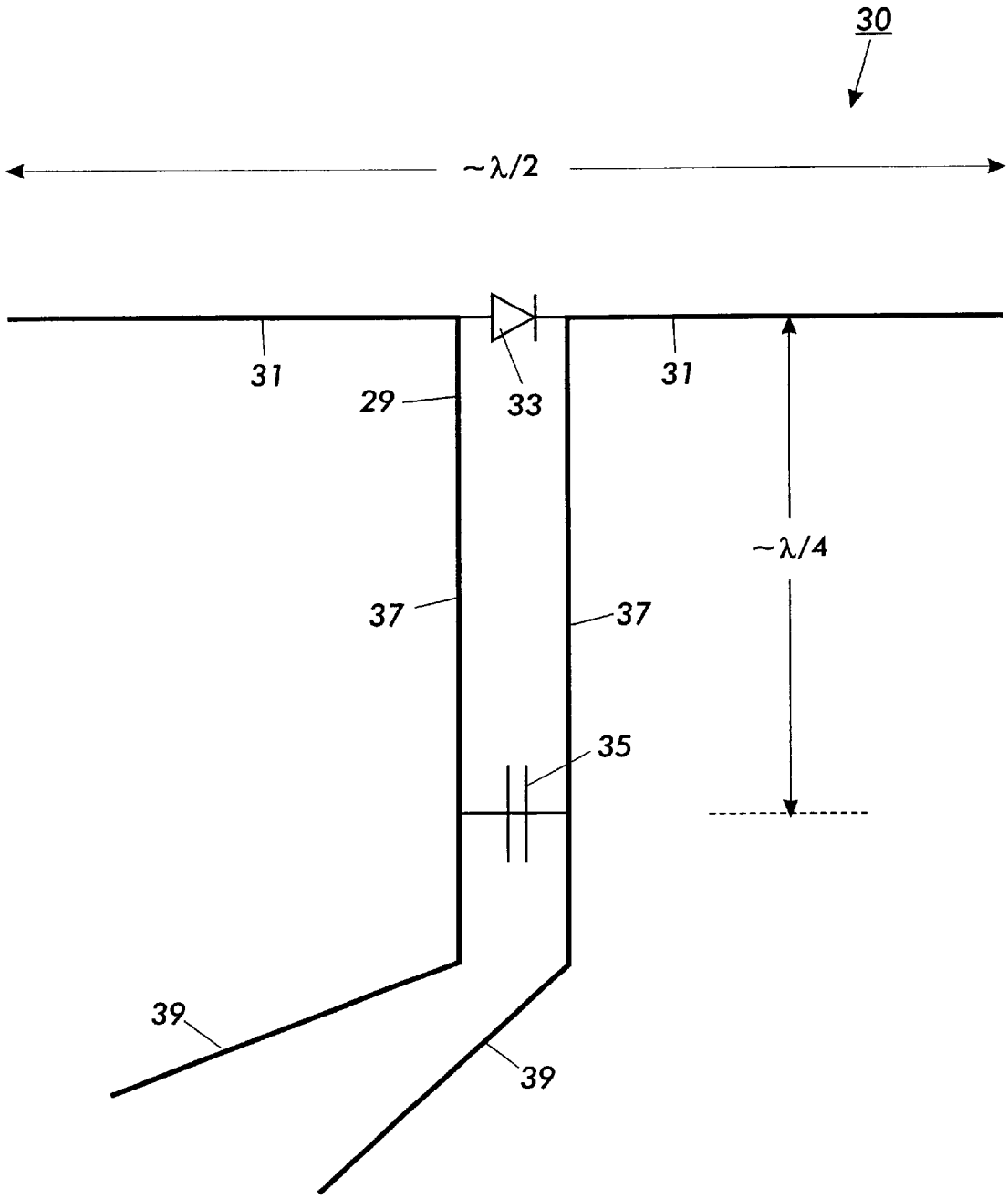
FIG. 3 illustrates a second exemplary embodiment of an integrated microwave imaging detector according to this invention.

FIG. 3 illustrates a second exemplary embodiment of an integrated microwave imaging detector 30 according to this invention. The integrated microwave imaging detector 30 is configured with two colinearly aligned quarter wavelength arms 31 connected at the center by a rectifier 33 such as, for example, a Schottky diode, a zero-bias Schottky diode or the like. The arms 31 are further connected via lines 37 to a voltage holding device 35, such as, for example, a capacitor, at a distance of approximately one-quarter wavelength from the diode 33. Voltages detected by the voltage holding device 35 are transferred to measuring and/or processing devices (not shown) via electrical lines 39.

It should be apparent to one of ordinary skill that the quarter wavelength lines 37 may operate as a high impedance filter at microwave frequencies to isolate the antenna elements from the rest of the device. Thus, the rectified signal may more easily pass through the quarter wavelength lines 37 to be transferred to the voltage holding device 35 or to other devices via electrical lines 39.

Figure 4:
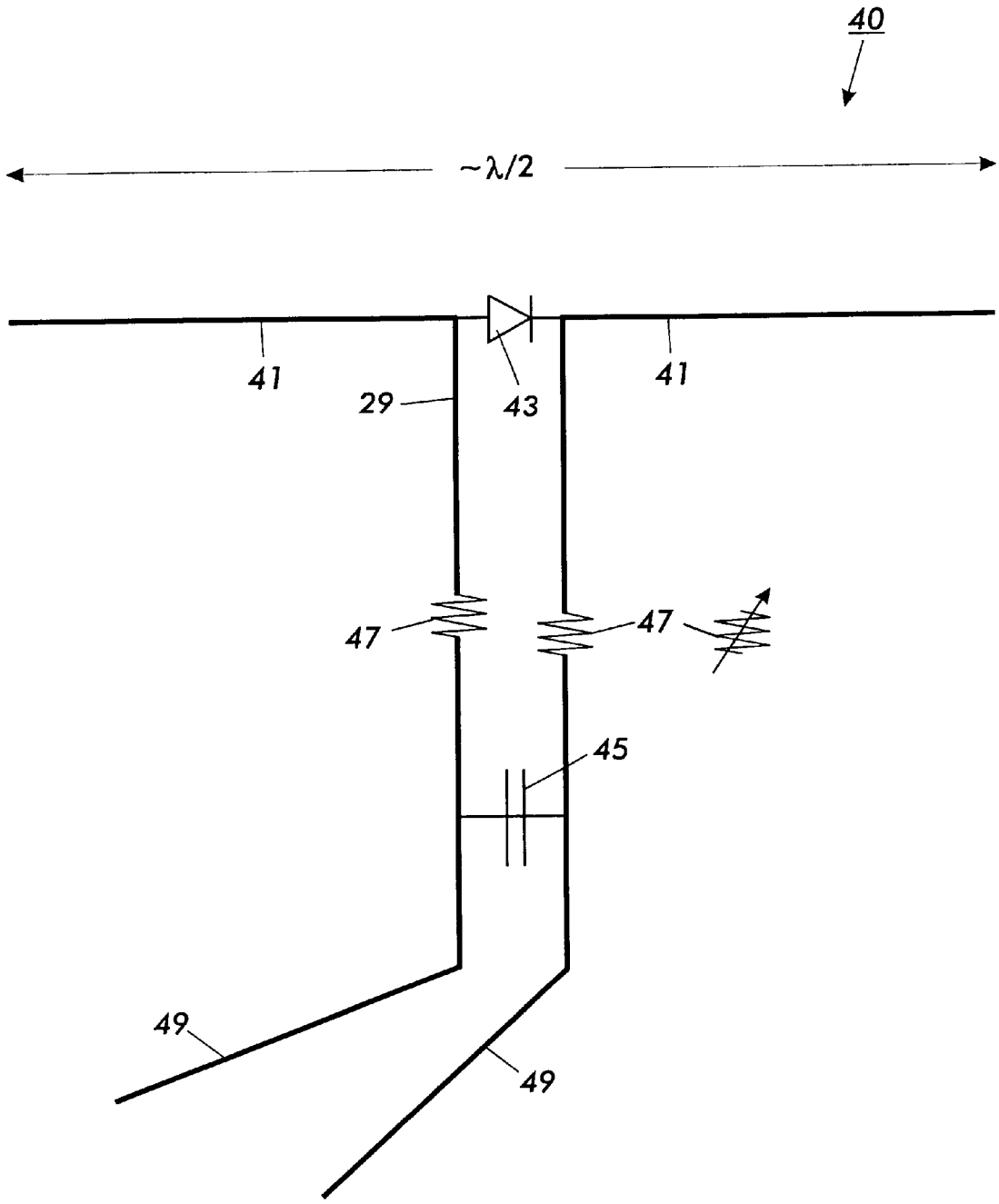
FIG. 4 illustrates a third exemplary embodiment of an integrated microwave imaging detector according to this invention.

FIG. 4 illustrates a third exemplary embodiment of a microwave imaging detector 40 according to this invention. Similarly to FIG. 3, the microwave imaging detector 40 possess a pair of colinear arms 41 bridged via a rectifier 43. The received signals are transferred to a voltage holding device 45 such as, for example, a capacitor, via lines having resistive elements 47. The resistive elements 47 can be variable in magnitude and operate to filter the receive signals. Voltages held by the voltage holding device 45 are transferred to other devices (not shown) via lines 49.

Figure 5:
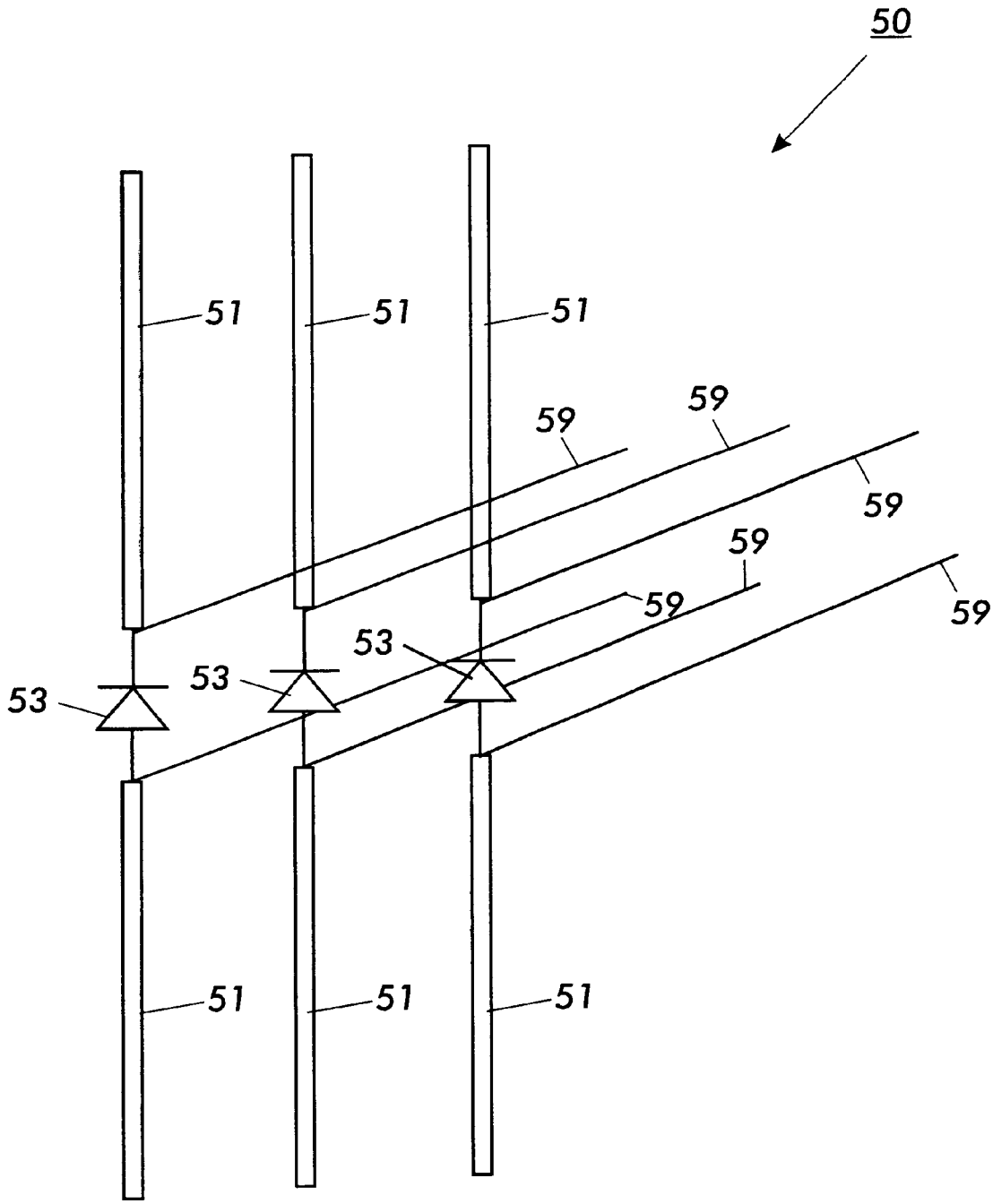
FIG. 5 illustrates a fourth exemplary embodiment of an integrated microwave imaging detector arranged into an array according to this invention.

FIG. 5 illustrates a fourth exemplary embodiment of a detector device 50 that incorporates an exemplary array of microwave imaging detectors 10. Pairs of quarter wavelength arms 52 are colinearly located in a planar arrangement to form an array of dipole antennas. Each arm 51 of a pair 52 is connected to the other arm 51 of that pair 52 via a rectifier 53. Voltages detected by the rectifier 53 are carried to other devices (not shown) by electrical wires 59.

It should be understood that, although FIG. 5 illustrates one exemplary embodiment of a detecting device that incorporates an array of microwave imaging detectors according to this invention, arrayed in a planar fashion, it will be readily apparent to one of ordinary skill in the art of antenna arrays that the microwave imaging elements 51–53 of FIG. 5 are not limited solely to using parallel dipole antenna elements. For example, in various exemplary embodiments, the dipole antenna elements may be non-parallel, or even perpendicular, to each other. Furthermore, the dipole antenna elements do not necessarily have to lie in a plane. That is, the dipole elements may be arranged in a non-planar fashion, for example, along a contoured surface, such as a sphere, a tetrahedron or other non-planar, multi-dimensional geometries.

Figure 6:
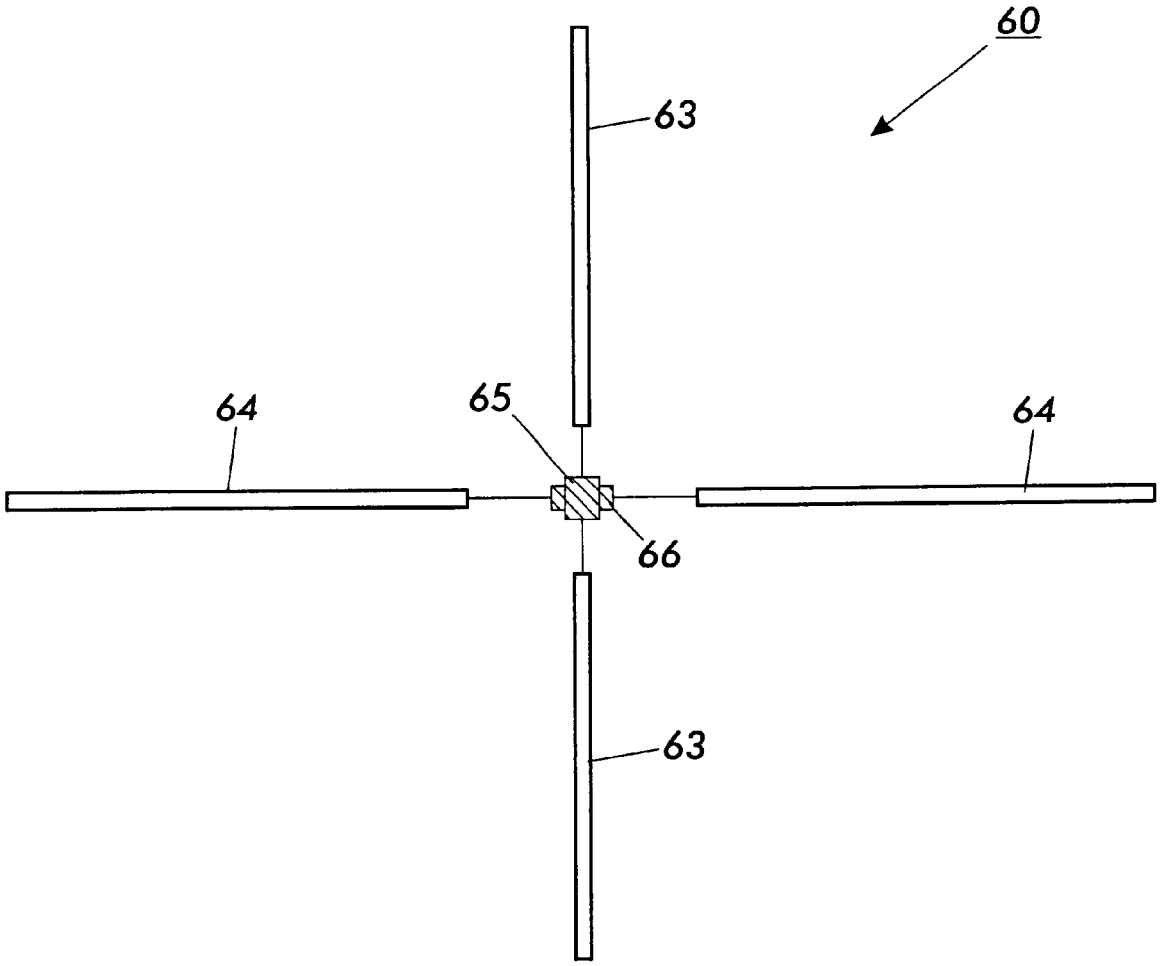
FIG. 6 illustrates a fifth exemplary embodiment of an integrated microwave imaging detector arranged into an array according to this invention.

FIG. 6 illustrates a fifth exemplary embodiment of an integrated microwave imaging detector device 60 that acts as an array of integrated microwave imaging detectors. The microwave imaging detector 60 may be non-colinearly placed to detect various polarizations of microwave energy. Quarter wavelength elements 63 and 64 may be perpendicularly situated with rectifiers 65 and 66 connecting the inner terminals of the respective quarter wavelength elements 63 and 64.

Figure 7:
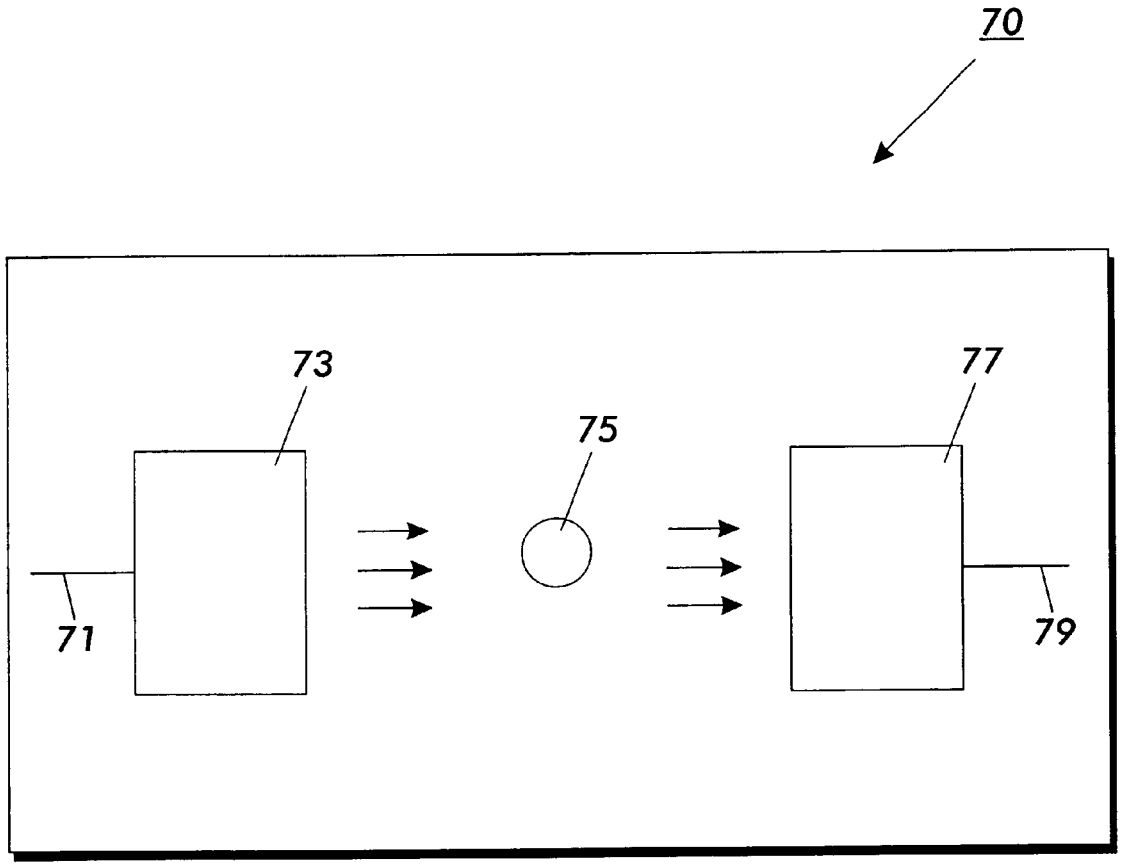
FIG. 7 is a block diagram illustrating an exemplary microwave imaging system according to this invention.

FIG. 7 is a block diagram of an exemplary microwave imaging system 70. A transmission line 71 propagates microwave energy to a transmitting element 73. The transmitting element 73 radiates microwave energy towards an object 75 to be imaged. Transmitted, scattered and/or reflected microwave energy is detected by an exemplary microwave imaging detector 77. The detected signal is transferred to one or more measuring and/or signal processing devices (not shown) via one or more signal lines 79. The exemplary microwave imaging detector 77 can be implemented using any of the first-fifth exemplary embodiments of the integrated microwave imaging detectors 20–60 described herein, as well as any other exemplary embodiment of an integrated microwave imaging detector designed and formed according to the inventive principles disclosed herein.

It should be appreciated that, in each of the exemplary integrated microwave imaging detectors illustrated in FIGS. 2–7, the integrated microwave imaging detectors can be fabricated using standard photolithographic or printed circuit board techniques, for example. Thus, mass production of highly reliable microwave imaging detectors can be facilitated. Furthermore, while the exemplary embodiments of the microwave detectors 20–60 shown in FIGS. 2–6 illustrate various combinations of a rectifier with capacitors and/or resistors, it is apparent to one of ordinary skill in the art that various other exemplary embodiments of an integrated microwave imaging detector according to this invention can be configured with alternative combinations of active and/or passive electric devices. For example, a voltage holding element, such as, for example, capacitor can be situated between the quarter wavelength antenna elements, in addition to the rectifier. Moreover, the voltage holding element can be omitted, if desired. Additionally, the lines 29 shown in FIG. 2 may be replaced with capacative elements, resistive elements or even inductive elements, as illustrated in FIG. 3, for example.

It should be appreciated that, while the exemplary embodiments of the microwave detectors 20–60 according to this invention illustrated in FIGS. 2–7 are described as being fabricated using standard photolithographic or printed circuit board techniques, other substantially mechanical or automated methods for fabricating conductive elements and circuit elements may be used. For example, a silk-screening technique or chemical vapor deposition technique may be used to fabricate various components of the exemplary microwave imaging detectors. For example, the exemplary microwave imaging detector of FIG. 3 may be fabricated by using printed board or other techniques to fabricate the antenna elements and the quarter wavelength lines 37. The rectifying element 33 and/or the voltage holding element 35 may then be attached to the antenna elements and/or the quarter wavelength line 37 by hand soldering, for example. Accordingly, it should be appreciated that alternative methods for fabricating the exemplary embodiments of the microwave detectors 20–60 according to this invention illustrated in FIGS. 2–7 may be used without departing from the spirit and scope of this invention.

While the above-outlined exemplary embodiments of the integrated microwave imaging detectors 20–60 describe a rectifier as being placed at the apex of the quarter wavelength elements, it should be appreciated that any known or later-developed rectifying element, such as, for example, a discrete diode or a semiconductor diode, may be suitably used to provide the same rectifying function as a diode. For example, a thin-film transistor may be function as a diode in the microwave detectors according to this invention.

Furthermore, it should also be appreciated that, while the exemplary embodiments of the integrated microwave imaging detectors according to this invention are described in the context of using quarter wavelength antenna elements to form a half wavelength dipole antenna, it will be apparent to those of ordinary skill in the art that the quarter wavelength antenna elements and the half wavelength dipole elements are understood as representing only approximate dimensional relationships to the wavelengths of the microwave frequencies being detected. That is, the quarter wavelength and half wavelength nomenclatures used are understood to be approximate. Thus, antenna elements substantially larger or smaller than a quarter wavelength and/or half wavelength of a particular wavelength of the microwave radiation used in the imaging system may be used without departing from the spirit and scope of this invention.

Accordingly, the term "quarter wavelength" and "half wavelength" as used above are not intended to limit the permissible extent of the various antenna elements to any particular relationship to the particular wavelength of the microwave radiation used in the imaging system. Rather, these terms are used merely to represent the relationship between the extent of the various circuit elements and the particular wavelength of the microwave radiation used in the imaging system that provides the most effective sensing of that particular wavelength of the microwave radiation used in the imaging system.

It should be appreciated that each of the exemplary embodiments of the integrated microwave imaging detectors shown in FIGS. 2–6 may be subject to many alternatives, modifications and variations as are apparent to those skilled in the art. Accordingly, exemplary embodiments of the invention as set forth herein are intended to be illustrative and not limiting. Thus, there are changes that may be made without departing from the spirit and scope of this invention.

What is claimed is:

1. A microwave detecting device comprising:

at least a pair of antenna elements;

a rectifying device directly connected between inner terminals of the pair of antenna elements; and an intermediate pair of conducting lines, approximately one-quarter wavelength in length, connected to the inner terminals of the pair of antenna elements and to a voltage holding device, wherein the intermediate conducting lines include resistive elements, and wherein the voltage holding device forms a parallel circuit with the rectifying device.

2. The microwave detecting device according to claim 1, wherein the pair of antenna elements approximately form a half wavelength antenna.

3. The microwave detecting device according to claim 2, wherein the half wavelength antenna operates to detect frequencies greater than approximately 8 GHz.

4. The microwave detecting device according to claim 2, wherein the half wavelength antenna operates to detect frequencies of less than approximately $1\times10^3$ GHz.

5. The microwave detecting device according to claim 1, wherein the rectifying device is a Schottky diode.

6. The microwave detecting device according to claim 1, wherein the rectifying device is a zero-bias Schottky device.

7. A microwave imaging system comprising:

a microwave transmitting device; and the microwave detecting device of claim 1.

8. The microwave detecting device according to claim 1, wherein at least one of the resistive elements is a variable resistive element.

9. A microwave detecting device comprising:

at least a pair of antenna elements;

a rectifying device directly connected between inner terminals of the pair of antenna elements; and an intermediate pair of conducting lines including resistive elements, the pair of conducting lines connected to the inner terminals of the pair of antenna elements and to a voltage holding device, wherein the voltage holding device forms a parallel circuit with the rectifying device.

10. The microwave detecting device according to claim 9, wherein at least one resistive element is a variable resistive element.

11. A microwave detecting apparatus comprising:

a plurality of microwave detecting devices according to claim 9.

12. The microwave detecting apparatus according to claim 11, wherein each of the plurality of pairs of antenna elements form an approximately half wavelength antenna.

13. The microwave detecting apparatus according to claim 12, wherein the half wavelength antennas operate to detect frequencies greater than approximately 8 GHz.

14. The microwave detecting apparatus according to claim 12, wherein the half wavelength antennas operate to detect frequencies less than approximately $1\times10^3$ GHz.

15. The microwave detecting apparatus according to claim 12, wherein the half wavelength antennas operate to detect frequencies approximately between 8 GHz and $1\times10^3$ GHz.

16. The microwave apparatus according to claim 11, wherein the plurality of pairs of antenna elements are in a substantially parallel arrangement.

17. The microwave detecting apparatus according to claim 11, wherein the rectifying device is a Schottky diode.

18. The microwave detecting apparatus according to claim 11, wherein the rectifying device is a zero-bias Schottky diode.

19. The microwave detecting apparatus according to claim 11, wherein at least a first pair of antenna elements is situated substantially perpendicular to at least a second pair of substantially colinear antenna elements.

20. A microwave imaging system comprising:

a microwave transmitting device; and the microwave detecting apparatus of claim 9.

21. A method for fabricating a microwave imaging detecting device comprising:

generating at least a pair of antenna elements using a substantially automated printing process, each element having an extent of approximately one-quarter wavelength; and electrically connecting a rectifying device directly to inner terminals of each of the pair of antenna elements;

generating an intermediate pair of conducting lines, approximately one-quarter wavelength in length, the generating an intermediate conductive lines includes generating a resistive element; and connecting the intermediate pair of conducting lines to the inner terminals of the pair of antenna elements and to a voltage holding device, wherein the voltage holding device forms a parallel circuit with the rectifying device.

22. The method of claim 21, further comprising:

generating intermediate conductive lines connected to the inner terminals of the quarter wavelength element by a substantially automated printing process, the conductive lines having an extent that is approximately one-quarter wavelength in length, and electrically connecting a voltage holding device to the intermediate conductive lines.

23. The method of claim 21, wherein generating the antenna elements comprises forming the antenna elements using a photolithographic printing process.

24. The method of claim 21, wherein generating the antenna elements comprises forming the antenna elements using a printed circuit board printing process.

25. The method of claim 21, wherein generating a resistive element includes generating a variable resistive element.

* * * * *